US007228261B2

(12) United States Patent
Leonard et al.

(10) Patent No.: US 7,228,261 B2
(45) Date of Patent: Jun. 5, 2007

(54) METHODS AND APPARATUS FOR TESTING AND DIAGNOSIS OF WEAPON CONTROL SYSTEMS

(75) Inventors: James V. Leonard, St. Charles, MO (US); William J. Ebert, Kirkwood, MO (US); Aaron L. Eggemeyer, Chester, IL (US); Richard E. Meyer, Florissant, MO (US); Bobby J. Wilson, Florissant, MO (US)

(73) Assignee: The Boeing Company, Chicago, IL (US)

( * ) Notice: Subject to any disclaimer, the term of this patent is extended or adjusted under 35 U.S.C. 154(b) by 671 days.

(21) Appl. No.: 10/640,865

(22) Filed: Aug. 13, 2003

(65) Prior Publication Data

US 2005/0081733 A1 Apr. 21, 2005

(51) Int. Cl.
*G06G 7/48* (2006.01)

(52) U.S. Cl. ..... 703/8; 703/6; 703/7; 434/13; 434/14; 701/1; 701/200

(58) Field of Classification Search ..... 703/6–8; 701/1, 200; 434/14, 13
See application file for complete search history.

(56) References Cited

U.S. PATENT DOCUMENTS 3,960,000 A 6/1976 Barnett et al.
4,253,249 A * 3/1981 Ashford et al. ..... 434/22
4,541,804 A * 9/1985 Armour et al. ..... 434/15
5,501,413 A 3/1996 Klinger et al.
5,548,510 A * 8/1996 Ebert et al. ..... 701/200
5,549,477 A 8/1996 Tran et al.
5,551,875 A * 9/1996 Shaffer et al. ..... 434/13
5,591,031 A * 1/1997 Monk et al. ..... 434/14
5,614,896 A * 3/1997 Monk et al. ..... 340/945
5,807,109 A * 9/1998 Tzidon et al. ..... 434/35
5,931,874 A * 8/1999 Ebert et al. ..... 701/1
6,067,851 A * 5/2000 Chaves et al. ..... 73/167
6,122,569 A 9/2000 Ebert et al.
6,349,898 B1 2/2002 Leonard et al.
6,604,064 B1 * 8/2003 Wolff et al. ..... 703/7
6,615,116 B2 9/2003 Ebert et al.

(Continued)

FOREIGN PATENT DOCUMENTS

WO WO 97/22230 A1 6/1997

OTHER PUBLICATIONS

"Generalized Micorcomputer-Based Harpoon Missile Simulation Trainer", Leonard et al, 13th Annual Simulation Symposium, IEEE 1980.*

(Continued)

*Primary Examiner*—Fred Ferris
(74) *Attorney, Agent, or Firm*—Lee & Hayes, PLLC

(57) ABSTRACT

Methods and systems for testing and diagnosis of weapon control systems are disclosed. In one embodiment, an apparatus for testing a weapon control system includes an interface unit and a simulator unit. The interface unit is adapted to be operatively coupled to the weapon control system, and the simulator unit is operatively coupled to the interface unit. The simulator unit receives and analyzes a control signal, and transmits at least one of a first type of responsive signal indicative of a properly functioning component, and a second type of responsive signal indicative of a malfunctioning component.

28 Claims, 6 Drawing Sheets

U.S. PATENT DOCUMENTS 6,945,780 B2 * 9/2005 Perry ..... 434/11
6,945,781 B2 * 9/2005 Perry et al. ..... 434/11
6,997,715 B2 * 2/2006 Perry et al. ..... 434/11
7,002,336 B2 * 2/2006 Leonard et al. ..... 324/158.1
7,092,867 B2 * 8/2006 Huang et al. ..... 703/21
2003/0204779 A1 * 10/2003 Belenger et al. ..... 714/22

OTHER PUBLICATIONS

ATX—Wikipedia, the free dictionary, Dec. 19, 2006.*

* cited by examiner

METHODS AND APPARATUS FOR TESTING AND DIAGNOSIS OF WEAPON CONTROL SYSTEMS

FIELD OF THE INVENTION

The present invention relates to methods and apparatus for testing and diagnosis of weapon control systems, and more specifically, to methods and apparatus for testing and diagnosis of air-launch missile control systems.

BACKGROUND OF THE INVENTION

One possible hazard of military activity is the danger to personnel posed by equipment malfunction. As the complexity of modem weapons systems continues to increase, the challenge of maintaining the reliability and safety of such weapon systems also increases. With regard to modem fighter aircraft, for example, the possibility of a malfunction may increase due to numerous factors, including the age of the aircraft, the number and severity of missions flown, the operational environment of the aircraft, and of course, the presence of hostile fire directed against the aircraft.

Among the possible types of equipment malfunctions that may occur are the type associated with the components within the aircraft associated with controlling the aircraft's weapons (e.g. electrical circuitry, hardware and software). The possibility of malfunction of an aircraft's weapons control system poses a hazard to personnel on board the aircraft, as well as the ground crew charged with properly equipping the aircraft with its stores of missiles or other weaponry. Although some aircraft may include limited self-diagnostic capabilities that attempt to detect malfunctions and alert an operator if a malfunction is detected, such self-diagnostic capabilities may not be perfect and may themselves be subject to malfunction. Therefore, a need exists for improved methods and apparatus for testing and diagnosis of weapon control systems for aircraft

SUMMARY OF THE INVENTION

The present invention is directed to methods and apparatus for testing and diagnosis of weapon control systems, and more specifically, to methods and apparatus for testing and diagnosis of control systems for air-launched missiles for aircraft. Apparatus and methods in accordance with the present invention may advantageously perform testing and diagnosis of certain components of an aircraft, thereby improving reliability and safety and reducing risks to personnel due to malfunctions.

In one embodiment, an apparatus for electrically simulating a weapon for testing a weapon control system includes an interface unit and a simulator unit. The interface unit is adapted to be operatively coupled to the weapon control system and includes a control circuit adapted to receive a control signal from the weapon control system. The simulator unit is operatively coupled to the interface unit and is adapted to receive and analyze the control signal, and to transmit at least one of a first type of responsive signal indicative of a properly functioning component and a second type of responsive signal indicative of a malfunctioning component.

BRIEF DESCRIPTION OF THE DRAWINGS

The preferred and alternative embodiments of the present invention are described in detail below with reference to the following drawings.

DETAILED DESCRIPTION OF THE INVENTION

The present invention relates to methods and apparatus for weapon system testing and diagnosis and for training flight and ground crews. Many specific details of certain embodiments of the invention are set forth in the following description and in FIGS. 1–6 to provide a thorough understanding of such embodiments. One skilled in the art, however, will understand that the present invention may have additional embodiments, or that the present invention may be practiced without several of the details described in the following description.

Figure 1:
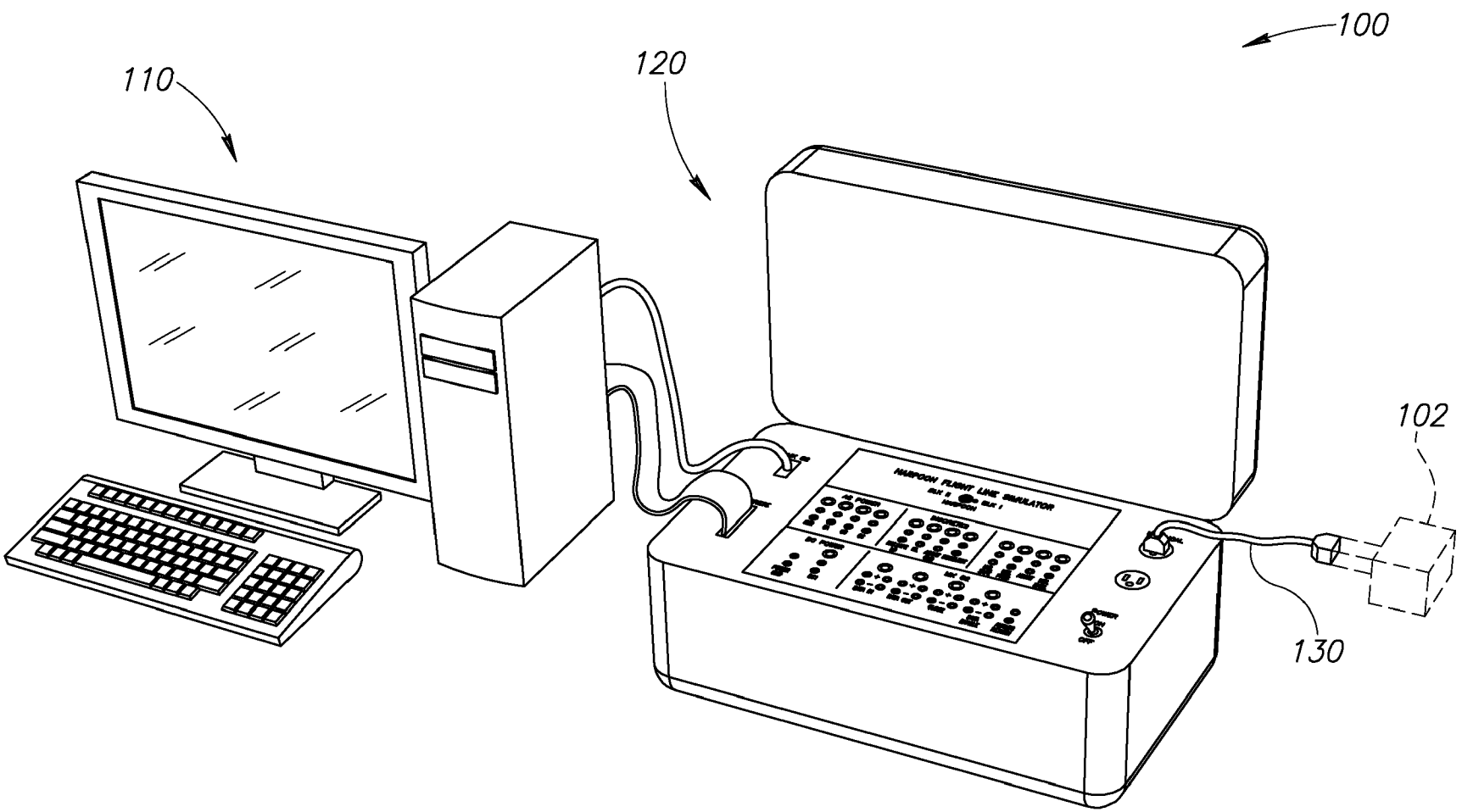
FIG. 1 is an isometric view of a simulator device for performing testing and diagnosis of a weapon system in accordance with an embodiment of the present invention.

FIG. 1 is an isometric view of a simulator device 100 for performing testing and diagnosis of a weapon control system 102 in accordance with an embodiment of the present invention. In this embodiment, the simulator device 100 includes a computer 110, an interface unit 120 coupled to the computer 110, and an umbilical cable 130 coupled between the interface unit 120 and the weapon control system 102. As described more fully below, in one aspect of the present invention, the simulator device 100 may be operated to simulate the operational characteristics of a weapon to perform testing and diagnosis of the weapon control system 102. More specifically, software routines within the computer 110 of the simulator device 100 may be selected to simulate the operational characteristics of various different weapons, including, for example, an air-launched missile, such as a Harpoon Block I-C or a Harpoon Block II Missile. Testing and diagnostic analyses may then be performed to check out the various functions of the weapon control system 102, including but not limited to the monitoring, arming, and firing functions of the system 102. Possible malfunctions of the weapon control system 102 may thereby be detected, diagnosed, and repaired prior to coupling an actual weapon onto the weapon control system 102.

In one particular embodiment, the weapon control system 102 may be an aircraft weapon control system, including, for example, the weapon control system of an F-16 or F-15 fighter aircraft, and the simulator device 100 may be configured to simulate an air-launched missile, such as, for example, an air-launched Harpoon Missile. It will be appreciated, however, that the simulator device 100 may be configured to simulate a variety of different weapons, and may be used in conjunction with a variety of different weapon control systems.

Figure 2:
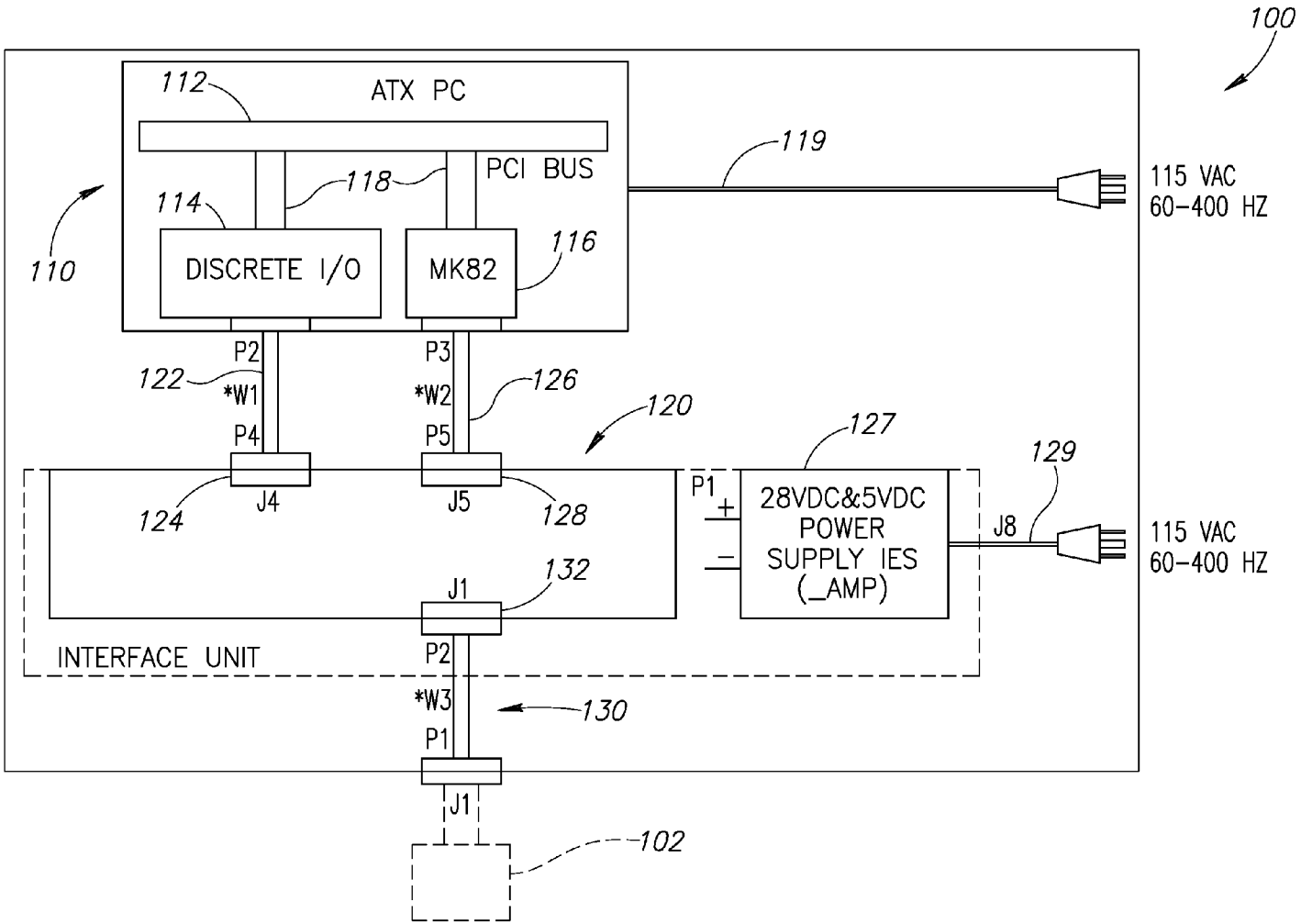
FIG. 2 is a block diagram of the simulator device of FIG. 1 in accordance with an embodiment of the present invention.

FIG. 2 is a block diagram of the simulator device 100 of FIG. 1 in accordance with an embodiment of the present invention. In this embodiment, the computer 110 includes a processor/memory device 112 coupled to an input/output (I/O) device 114 and to a missile data communication device 116 by PCI buses 118. The processor/memory device 112 and I/O device 114 may be of conventional design. In one particular embodiment, the processor/memory device 112 is an ATX PC type of processor. The processor/memory device 112 may include a software routine operatively disposed therein, the software routine being adapted to receive and analyze a control signal from the weapon control system and to formulate a corresponding responsive signal based on a desired weapon simulation mode, as described more fully below. Alternately, the processor/memory device 112 may simulate the desired weapon simulation mode using one or more hardware components, including, for example, programmable and semi-programmable hardware components. Similarly, the missile data communication device 116 may include various hardware and software components that may be selected based on the particular characteristics of the weapon or weapons, such as the Harpoon MK-82 Digital Data Bus, that are desired to be simulated using the simulation device 100. In one particular embodiment, the missile data communication device 116 is a Harpoon MK-82 Digital Data Bus Transceiver for imitating a payload of a Harpoon-type air-launched missile.

As further shown in FIG. 2, a first power cord 119 provides power to the computer 110. The computer 110 is coupled to the interface unit 120 by a first cable 122 coupled between the I/O device 114 and a first port 124 on the interface unit 120, and by a second cable 126 coupled between the missile data communications device 116 and a second port 128. A second power cord 129 provides power to an AC to DC converter 127 of the interface unit 120. Finally, the umbilical cable 130 is coupled to a third port 132 on the interface unit 120.

Figure 3:
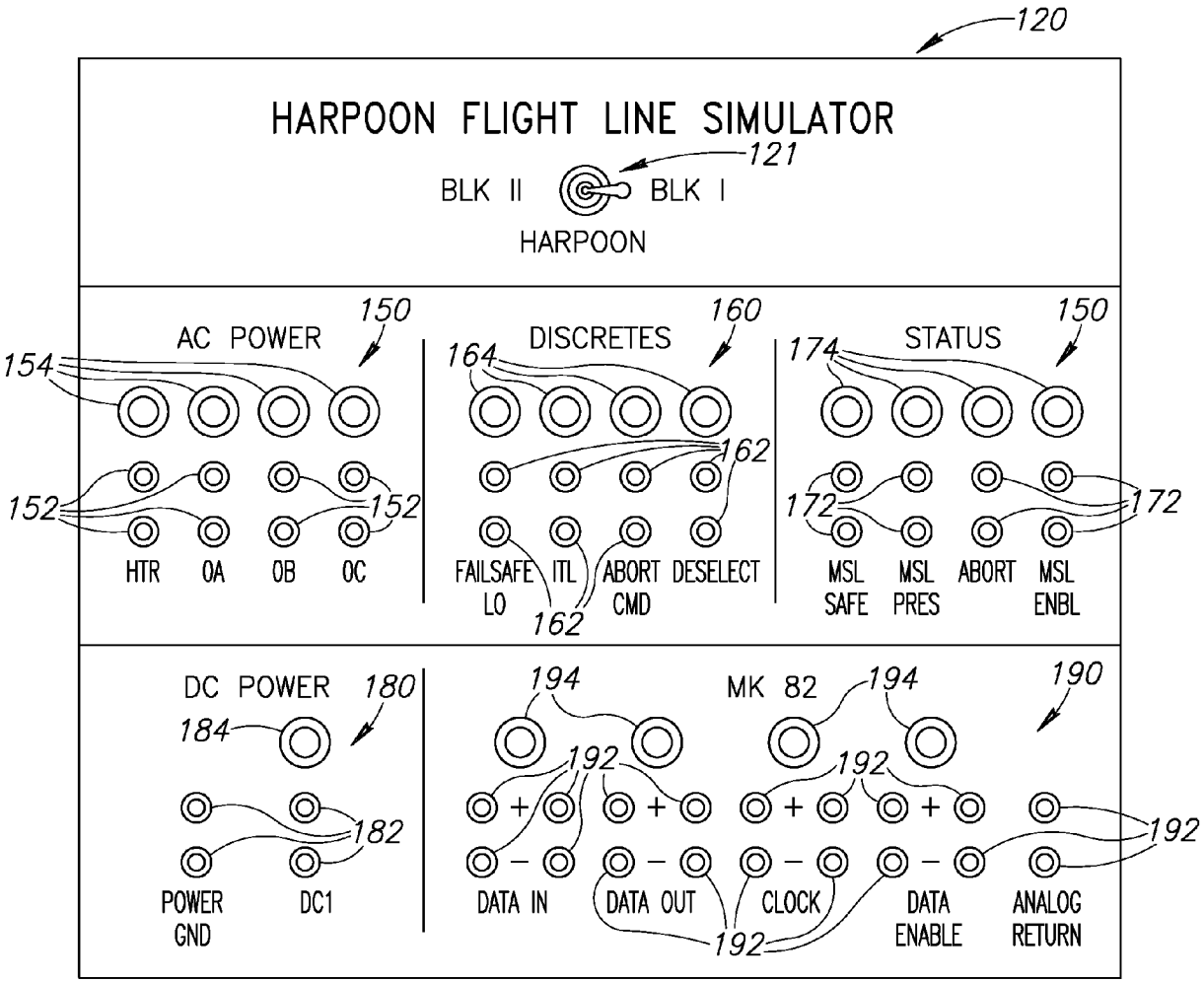
FIG. 3 is a schematic view of an interface unit of the simulator device of FIG. 1 in accordance with an embodiment of the present invention.
Figure 4:
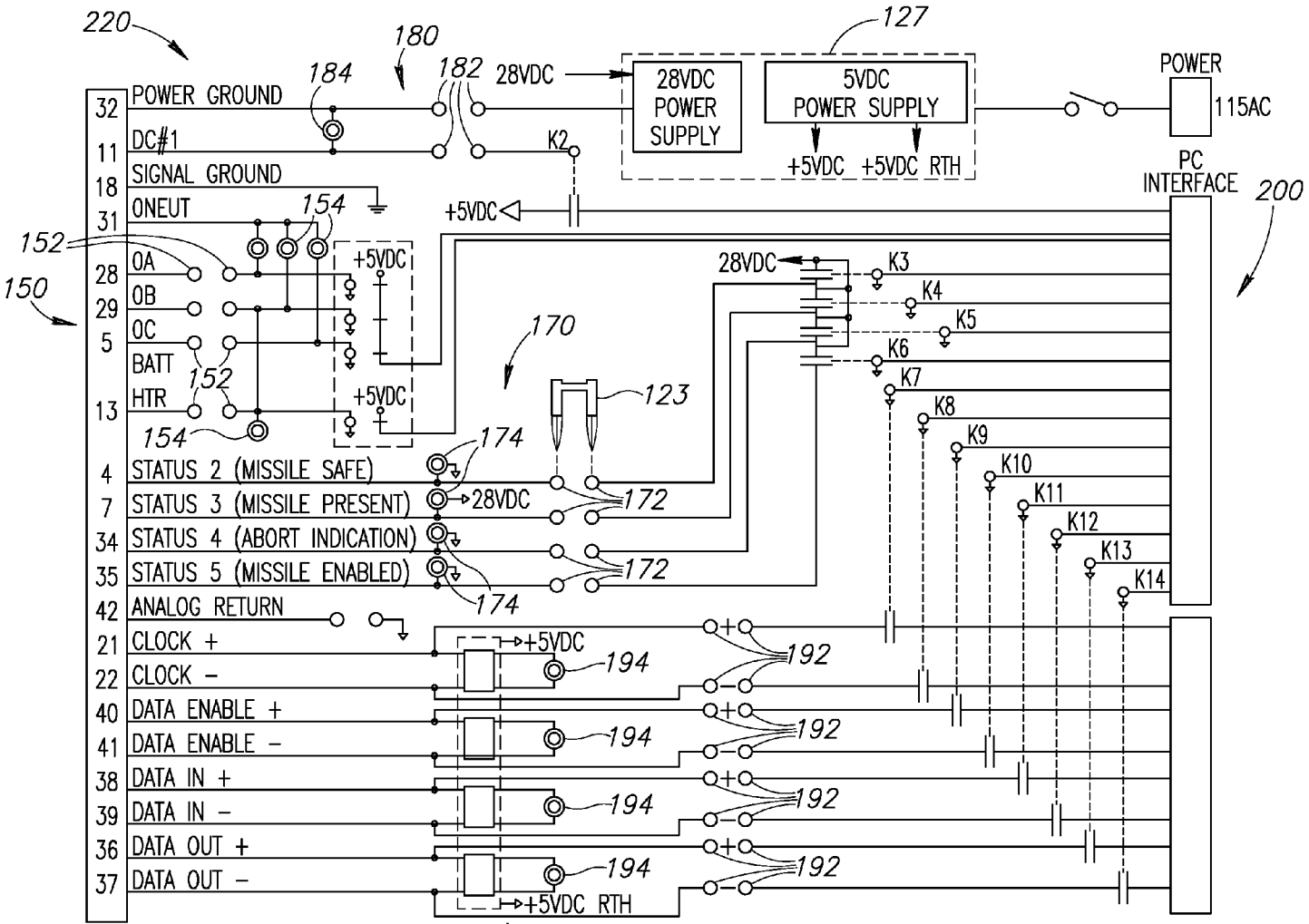
FIG. 4 is a schematic view of a first portion of a control circuit of the interface unit of FIG. 3 in accordance with an embodiment of the present invention.
Figure 5:
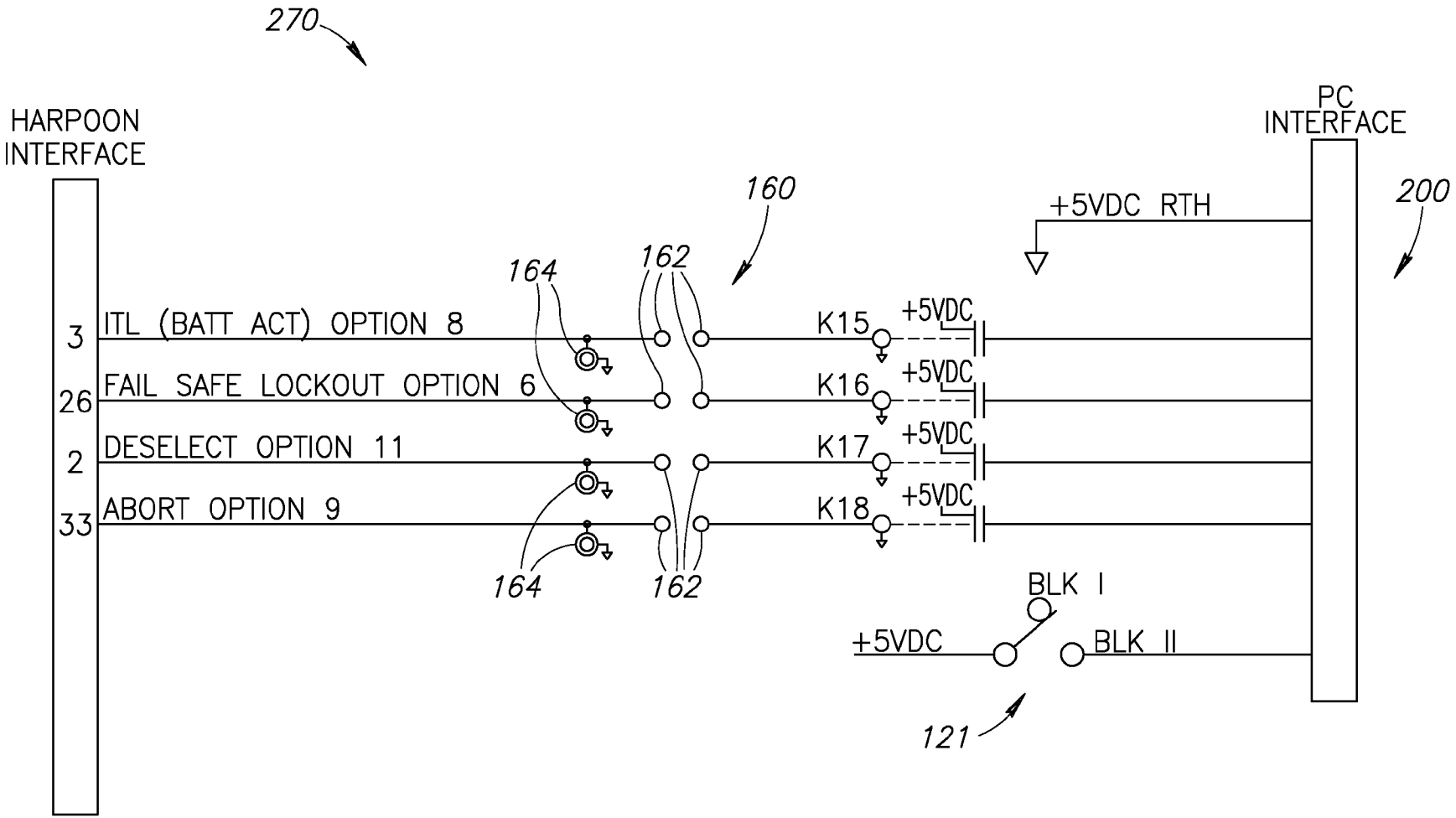
FIG. 5 is a schematic view of a second portion of a control circuit of the interface unit of FIG. 3 in accordance with an embodiment of the present invention.

FIG. 3 is an operator's view of the interface unit 120 of the simulator device 100 of FIG. 1 in accordance with an embodiment of the present invention. FIGS. 4 and 5 are schematic views of first and second portions 220, 270, respectively, of a control circuit 200 of the interface unit 120 of FIG. 3. In this embodiment, the interface unit 120 includes a primary selector 121 that permits an operator to select between different simulation modes. In one particular embodiment, for example, the primary selector 121 enables the operator to select between simulation of a Harpoon Block I and a Harpoon Block II Missile. In alternate embodiments, the primary selector 121 may be utilized to switch between any desired number and type of different weapon simulation modes.

As further shown in FIG. 3, in this embodiment, the interface unit 120 includes an AC power diagnostics portion 150, a discrete diagnostics portion 160, a status diagnostics portion 170, a DC power diagnostics portion 180, and a communications diagnostics portion 190. The internal circuitry associated with the AC power diagnostics portion 150, the status diagnostics portion 170, the DC power diagnostics portion 180, and the communications diagnostics portion 190 are included within the first portion 220 of the control circuit 200 (FIG. 4), and the circuitry associated with the discrete diagnostics portion 160 and the primary selector 121 are included in the second portion 270 of the control circuit 200 (FIG. 5).

With continued reference to FIGS. 3 and 4, the AC power diagnostics portion 150 includes a battery heater (HTR) test circuit, and 3-phase (A, B, & C) test circuits for simulating various power-carrying circuits of an actual weapon. Each of the HTR, 3-phase (A, B, & C) power test circuits includes a pair of pin receptacles 152 for receiving a dual-pin shorting connector 123 (FIG. 4) to complete each respective circuit, and an indicator light 154 that provides a visual indication of whether each circuit is energized. Similarly, the status diagnostics portion 170 includes a missile safe (MSL SAFE) circuit, a missile present (MSL PRES) circuit, an abort indication (ABORT) circuit, and a missile enable (MSL ENDBL) circuit, each of which include a pair of pin receptacles 172 and an associated indicator light 174. The DC power diagnostics portion 180 includes a power ground (POWER GND) circuit and a direct current (DC 1) circuit, each of which include a pair of pin receptacles 182 and an indicator light 184. Similarly, the communications diagnostics portion 190 includes a data in circuit, a data out circuit, a clock circuit, a data enable circuit, and an analog return circuit, each of which include a pair of pin receptacles 192 and an indicator light 194. Finally, with reference to FIGS. 3 and 5, the discrete diagnostics portion 160 includes a failsafe lockout (FAILSAFE LO) circuit, an ITL (BATT ACT) circuit, an abort (ABORT CMD) circuit, and a deselect circuit, each of which includes an associated pair of pin receptacles 162 and an indicator light 164.

Figure 6:
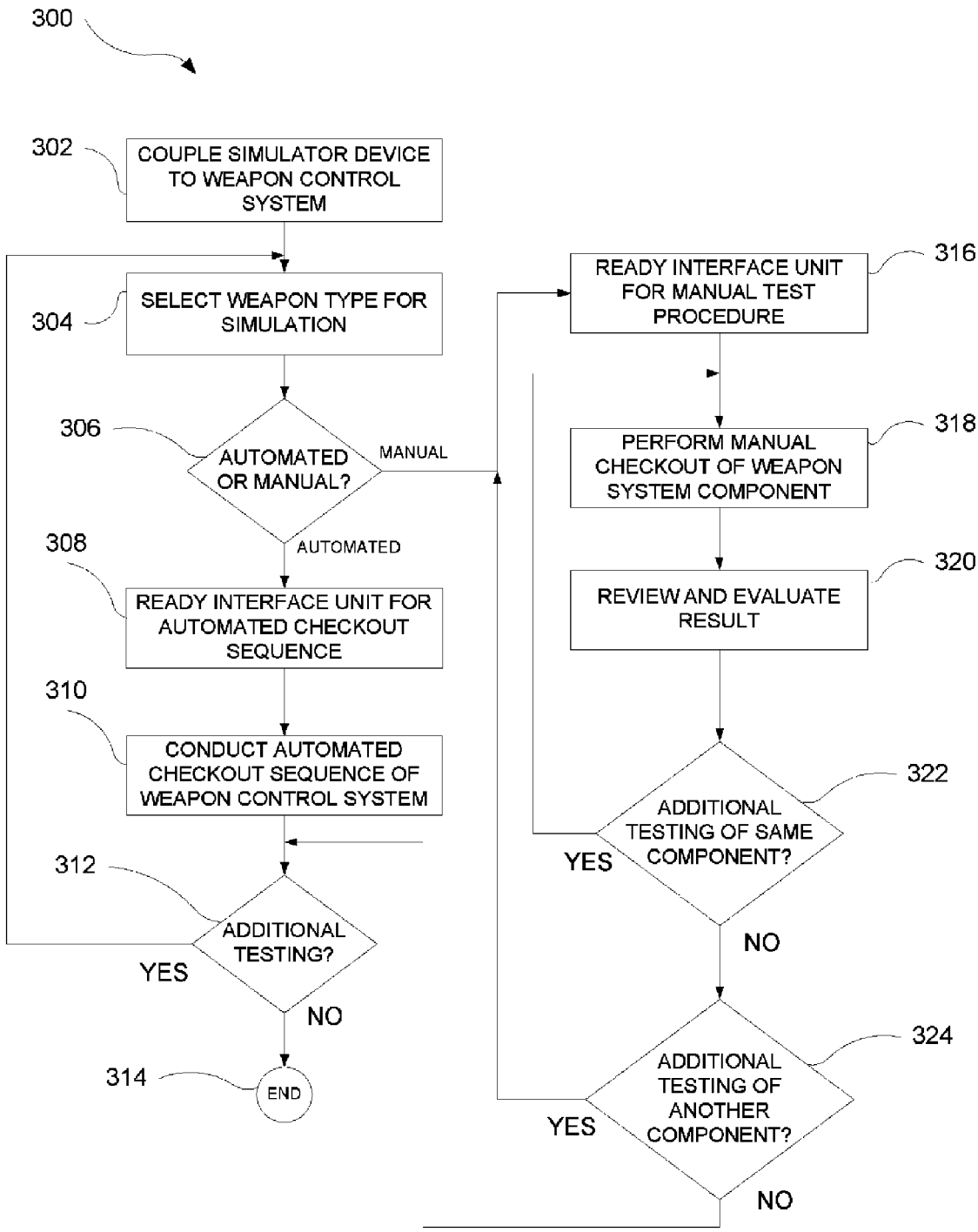
FIG. 6 is a flowchart of a method of performing testing and diagnosis of a weapon control system in accordance with an embodiment of the present invention.

FIG. 6 is a flowchart of a method 300 of performing testing and diagnosis of a weapon control system 102 in accordance with an embodiment of the present invention. In this embodiment, the method 300 includes coupling the simulator device 100 to the weapon control system 102 via the umbilical 130 at a block 302. At a block 304, the operator selects the type of weapon, such as the Harpoon Block I Weapon or Harpoon Block II Weapon, that the simulator device 100 will simulate by actuating the primary selector 121 (FIG. 3). A determination is made whether to conduct automated or manual checkout of the weapon control system in a block 306. If the automated checkout option is selected, then at a block 308, the interface unit 120 is prepared for conducting an automated checkout sequence. For example, in one embodiment, the interface unit 120 may be readied for conducting the automated checkout sequence by installing a plurality of pin connectors 123 in some or all of the various pin receptacles 152, 162, 172, 182, 192 of the control circuit 200.

As further shown in FIG. 6, an automated checkout sequence of the weapon control system is conducted at a block 310. In one particular embodiment, the automated checkout sequence may include the weapon control system 102 transmitting one or more control signals through the umbilical 130 and through the control circuit 200 of the interface unit 120 to the computer 110. The computer 110 may then receive and process the one or more control signals, and may then transmit one or more response signals back to the weapon control system 102. In one aspect, the one or more response signals may be formulated by the computer 110 to simulate a properly functioning weapon system component, or alternately, the one or more response signals may be characteristic of an improperly functioning weapon system component. The weapon control system 102 may receive the one or more response signals and may take appropriate action, including, for example, providing an alert or notification to personnel monitoring the weapon control system 102 of the condition of the weapon system component (e.g. functioning or malfunctioning), or transmitting one or more secondary control signals to the simulation device 100, or other possible action. This process may then be automatically repeated for some or all of the circuits of the diagnostics sections 150, 160, 170, 180, 190 of the interface unit 120 described above.

Following the automated checkout sequence (block 310), the method 300 may further include a determination of whether to perform additional diagnostic testing of the weapon control system 102 at a block 312. For example, in one aspect of a method of testing in accordance with the present invention, some or all of the capabilities of the weapon control system 102 may be checked out using responsive signals from the simulator device 100 that are indicative of a properly functioning weapon system, and then additional testing may be accomplished using responsive signals that are indicative of a malfunctioning weapon system, to examine and verify the capabilities of the weapon control system to handle both types of conditions. Alternately, the additional testing may be repeated for a different component of the weapon control system 102, or for a different type of weapon. If it is determined that additional testing is desired at block 312, the method 300 returns to the selection of the type of weapon for simulation at block 304, and continues as described above. If it is unnecessary to perform additional diagnostic testing of the weapon control system 102, then the method 300 may simply terminate at a block 314.

Returning again to the determination block 306, if it is determined that diagnostic testing will be conducted manually, then at a block 316, the interface unit is readied for manual testing. Again, block 316 may include, for example, installing or removing one or more pin connectors 123 to complete or disrupt one or more of the particular circuits of the control circuit 200 of the interface unit 120 described above. The weapon control system 102 may then be manually commanded to transmit one or more control signals to the simulator device 100 (i.e. through the umbilical cable 130 and the interface unit 120 to the computer 110) to checkout one or more components of the weapon control system 102 at a block 318. The manual checkout of block 318 may include monitoring the indicator lights 154, 164, 174, 184, 194 of the interface unit 120 and the results presented on the display screen of the computer II, or observation and analysis of any other suitable diagnostic data. For example, any desired type of meter or suitable monitoring equipment may be coupled to the various subcircuits of the control circuit 200 (e.g. by coupling to the pin receptacles) to monitor various characteristics of the control circuit 200, including voltage levels and signal quality.

With continued reference to FIG. 6, in this embodiment, the results of the manual checkout of the weapon system component are reviewed and evaluated at a block 320. A determination is then made whether to perform additional testing of the weapon system component at a block 322. If additional testing is necessary, the method 300 returns to block 318 to conduct the additional testing. If additional testing is unnecessary, then the method 300 proceeds to determine whether any additional testing of any other weapon system components are necessary at a block 324. If other components remain to be tested, the method 300 returns to block 316 to ready the interface unit for additional manual testing. Alternately, if there are no other components to test, then the method 300 returns to the determination at block 312 to decide whether testing and diagnosis of the weapon control system 102 will be repeated using a different weapon simulation mode. Depending on the outcome of this determination, the method 300 returns to block 304 for selection of an additional type of weapon simulation, or alternately, proceeds to block 314 and terminates.

The simulator device 100 advantageously provides a versatile, compact, and mobile system for testing and diagnosing the performance of a weapon control system 102. Because the simulator device 100 is able to provide responsive signals and communications data that simulate both functioning and malfunctioning weapon system components, the capabilities of the weapon control system 102 under test may be fully investigated, and problems may be detected and corrected in the absence of an actual weapon. Therefore, the apparatus and methods in accordance with the present invention advantageously allow testing and diagnosis of malfunctions of the weapon control system 102 prior to coupling an actual weapon to the weapon control system 102, thereby improving the reliability of the weapon control system 102 and enhancing the safety of the weapon control system 102 for surrounding military (and civilian) personnel.

It will be appreciated that the weapon control system 102 may be any desired type of weapon control system from of any type vehicle or weapon control platform. For example, the weapon control system may be that of an aircraft, ship, remotely-piloted vehicle, land vehicle, or any other suitable type of weapon platform. In particular aspects, the weapon control system 102 may be that of an F-15 or an F-16 fighter aircraft. In alternate aspects, the inventive apparatus and methods disclosed herein may also be employed in any other types of aircraft, such as rotary aircraft or manned military aircraft, including those described, for example, in The Illustrated Encyclopedia of Military Aircraft by Enzo Angelucci, published by Book Sales Publishers, September 2001, and incorporated herein by reference.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. An apparatus for electrically simulating a weapon for testing a weapon control system comprising:

an interface unit configured to be operatively coupled to the weapon control system and including a control circuit configured to receive a control signal from the weapon control system, wherein the weapon control system is configured to be included in an aircraft; and a simulator unit operatively coupled to the interface unit and configured to receive the control signal, the simulator unit being further configured to analyze the control signal and to transmit at least one of a first type of responsive signal indicative of a properly functioning component and a second type of responsive signal indicative of a malfunctioning component, wherein the simulator unit includes an ATX type computer having a processor and memory.

2. The apparatus of claim 1, wherein the simulator unit further includes a software routine operatively disposed within the memory, the software routine being configured to receive and analyze the control signal and to formulate a corresponding responsive signal based on a desired weapon simulation mode.

3. The apparatus of claim 1, wherein the interface unit includes a primary selector for selecting between a first weapon simulation mode and a second weapon simulation mode.

4. The apparatus of claim 1, wherein the interface unit includes an A/C power diagnostics section having at least one of a battery heater circuit, and a 3-phase (A, B, & C) power-carrying circuit.

5. The apparatus of claim 4, wherein each of the battery heater circuit, and the 3-phase (A, B, & C) power-carrying circuits includes a pair or pin receptacles configured to receive a pin connector, and an indicator light configured to light when each circuit is energized.

6. The apparatus of claim 1, wherein the interface unit includes a status diagnostics portion having at least one of a weapon safe circuit, a weapon present circuit, an abort indication circuit, and a weapon enable circuit.

7. The apparatus of claim 6, wherein each of the weapon safe, weapon present, abort indication, and weapon enable circuits includes a pair of pin receptacles configured to receive a pin connector, and an indicator light configured to light when each circuit is energized.

8. The apparatus of claim 1, wherein the interface unit includes a DC power diagnostics portion having at least one of a power ground circuit and a direct current circuit.

9. The apparatus of claim 8, wherein each of the power around and direct current circuits includes a pair of pin receptacles configured to receive a pin connector, and an indicator light configured to light when each circuit is energized.

10. The apparatus of claim 1, wherein the interface unit includes a data communications diagnostics portion having at least one of a data in circuit, a data out circuit, a clock circuit, a data enable circuit, and an analog return circuit.

11. The apparatus of claim 10, wherein each of the data in, data out, clock, data enable, and analog return circuits includes a pair of pin receptacles configured to receive a pin connector, and an indicator light configured to light when each circuit is energized.

12. The apparatus of claim 10, wherein the data communications diagnostics portion is configured to simulate a Harpoon MK-82 Digital Data Bus Transceiver.

13. The apparatus of claim 1, wherein the interface unit includes a discrete diagnostics portion having at least one of a failsafe lockout circuit, an ITL circuit, an abort circuit, and a deselect circuit.

14. The apparatus of claim 13, wherein each of the failsafe lockout, ITL, abort and deselect circuits includes a pair of pin receptacles configured to receive a pin connector, and an indicator light configured to light when each circuit is energized.

15. The apparatus of claim 1, wherein the simulator unit is configured to simulate at least one of a Harpoon Block I and a Harpoon Block II air-launched missile.

16. The apparatus of claim 1, further comprising an umbilical operatively coupled to the interface unit and configured to be operatively coupled to the weapon control system.

17. A method of testing an aircraft weapon control system, comprising:

providing a weapon simulator having an interface unit configured to be operatively coupled to the weapon control system that is configured to be included in an aircraft, and a simulator unit operatively coupled to the interface unit, wherein the simulator unit includes an ATX type computer having a processor and memory;

receiving a control signal from the weapon control system into the weapon simulator;

analyzing the control signal using the ATX type computer; and transmitting a first type of responsive signal indicative of a properly functioning component and a second type of responsive signal indicative of a malfunctioning component.

18. The method of claim 17, wherein providing a weapon simulator having an interface unit includes providing a weapon simulator having a primary selector for selecting between a first weapon simulation mode and a second weapon simulation mode.

19. The method of claim 17, wherein receiving a control signal from the weapon control system includes receiving a control signal automatically generated by the weapon control system.

20. The method of claim 17, wherein receiving a control signal from the weapon control system includes receiving a control signal manually generated by the weapon control system.

21. The method of claim 17, wherein analyzing the control signal includes analyzing the control signal using a processor and a software routine.

22. The method of claim 17, further comprising determining whether to conduct the testing automatically or manually.

23. The method of claim 22, wherein after determining to conduct the testing manually, the method further comprises evaluating a result based on the responsive signal, and performing additional testing of the weapon control system.

24. The method of claim 17, further comprising performing additional testing of the weapon control system.

25. The method of claim 24, wherein performing additional testing of the weapon control system includes performing additional testing of other capabilities of the weapon control system.

26. The method of claim 24, wherein performing additional testing of the weapon control system includes performing additional testing of the weapon control system using a different weapon simulation mode of the weapon simulator.

27. The method of claim 17, wherein analyzing the control includes analyzing the control signal using a processor and a software routine.

28. The apparatus of claim 1, wherein the simulator unit has both automatically and manual testing functionality.

* * * * *